US005209036A

United States Patent [19]

Cancilliari

[11] Patent Number: 5,209,036

[45] Date of Patent: May 11, 1993

[54] INSULATING MEMBER AND METHOD FOR INSULATING A BUCK OF A DWELLING WALL

[76] Inventor: Scott J. Cancilliari, 8984 Bridge, Grosse Ile, Mich. 48138

[21] Appl. No.: 786,508

[22] Filed: Nov. 1, 1991

[51] Int. Cl.[5] ..... E04C 1/00

[52] U.S. Cl. ..... 52/309.4; 52/743; 52/309.9; 52/309.8; 52/741.4; 52/745.09

[58] Field of Search ..... 52/309.9, 309.8, 309.4, 52/743, 741

[56] References Cited

U.S. PATENT DOCUMENTS

| | | | |
|---|---|---|---|
| 2,094,635 | 10/1937 | Brooks . | |
| 3,251,912 | 5/1966 | Fish | 52/743 |
| 3,991,252 | 11/1976 | Kolakowski | 52/309.9 X |
| 4,177,618 | 12/1979 | Felter | 52/743 |
| 4,224,774 | 9/1980 | Petersen . | |
| 4,257,204 | 3/1981 | Rieger . | |
| 4,265,688 | 5/1981 | Gorski | 52/309.9 X |
| 4,346,543 | 8/1982 | Wilson et al. . | |
| 4,720,948 | 1/1988 | Henley et al. . | |
| 4,852,322 | 8/1989 | McDermid . | |
| 4,972,635 | 11/1990 | Wageman . | |
| 5,003,742 | 4/1991 | Dettbarn . | |
| 5,079,885 | 1/1992 | Dettbarn | 52/309.8 X |

*Primary Examiner*—Richard E. Chilcot, Jr.
*Assistant Examiner*—Beth A. Aubrey
*Attorney, Agent, or Firm*—Harness, Dickey & Pierce

[57] ABSTRACT

A method and apparatus adapted to insulate a buck of a wall of a dwelling such as a house. The method of the present invention includes placing an elongated, generally rigid insulating member having a height of about 92 and $\frac{5}{8}$ inches, a width of about 3.5 inches and a depth of about 2 inches within a buck of a wall while the wall is under construction. The buck itself is formed by fixedly securing a pair of 2×4 inch studs on opposite side portions of a third 2×4 inch stud, to thereby place inner surfaces of the 2×4 inch studs about 3.5 inches apart. A third 2×4 inch stud is positioned such that an outer surface thereof is substantially flush with rearward edge surfaces of the pair of 2×4 inch studs, to thereby form an elongated cavity having a width of about 3.5 inches and a depth of about 2 inches, the cavity representing the buck. The insulating member is manually, slidably inserted into the buck while the wall is under construction, and preferably in a horizontal position relative to the ground. A sheet of sheathing is then secured over forward edge surfaces of the pair of 2×4 inch studs and an outer surface of the insulating member. The insulating member substantially occupies the buck and significantly reduces air flow within the buck, to thereby help prevent air from reaching an interior area of the dwelling. The insulating member itself is preferably formed of a styrofoam-like material which may be easily transported to and handled at a work site.

8 Claims, 1 Drawing Sheet

FIG 1
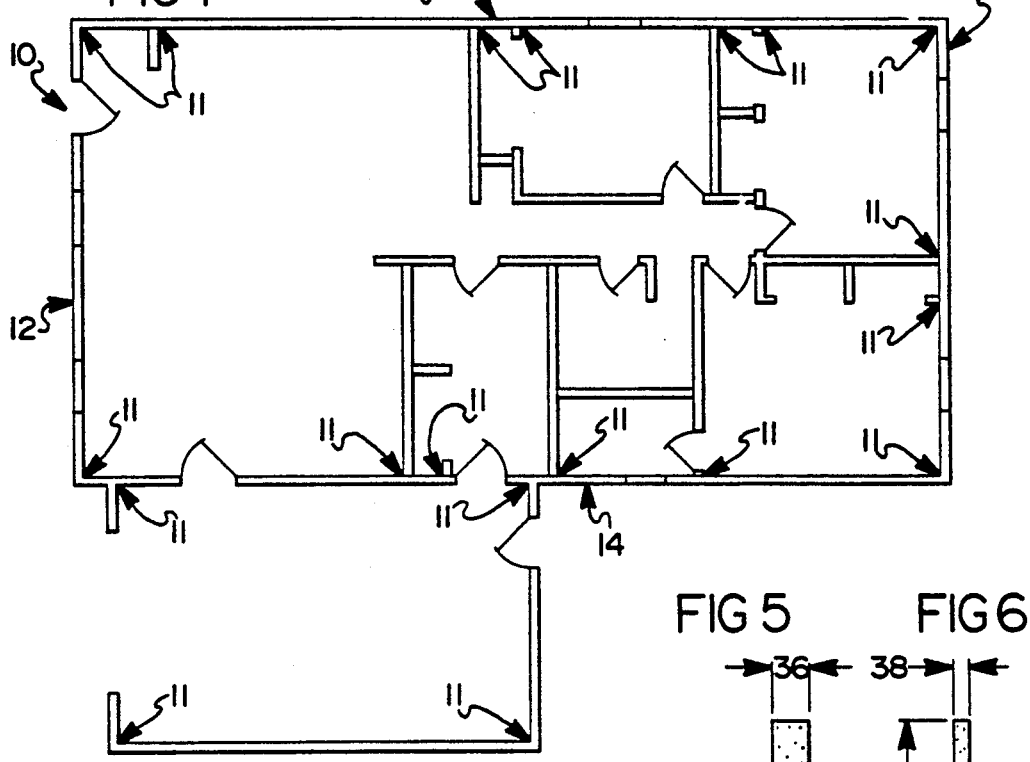
FIG 2
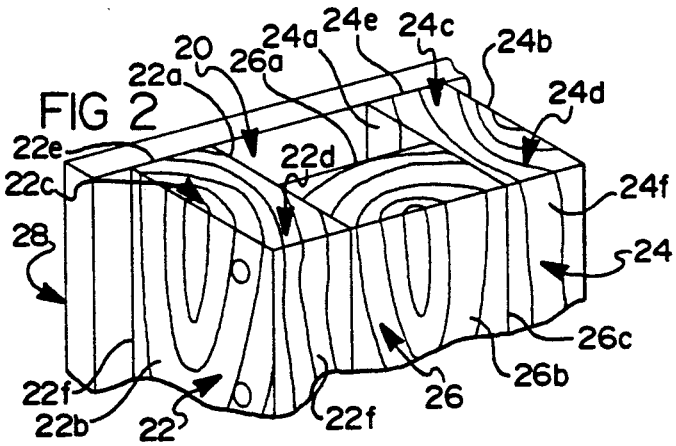
FIG 5
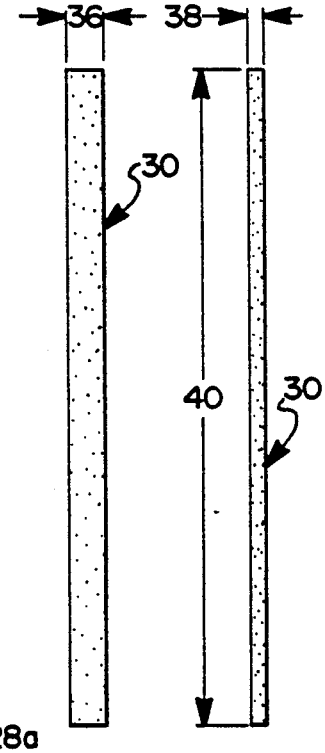
FIG 6
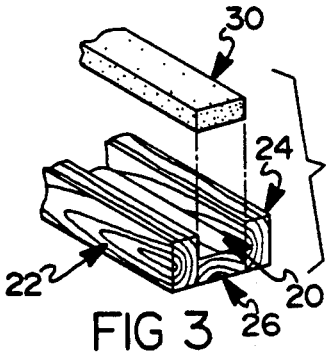
FIG 3
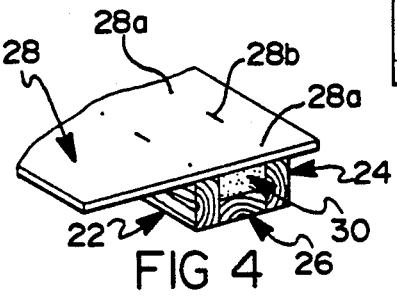
FIG 4

INSULATING MEMBER AND METHOD FOR INSULATING A BUCK OF A DWELLING WALL

TECHNICAL FIELD

This invention relates to insulating methods and components for insulating dwellings, and particularly to a method and apparatus for insulating a buck area of a wall of a house such as a dwelling while the dwelling is under construction.

BACKGROUND

When constructing dwellings such as residential houses, it is somewhat standard for carpenters and other like skilled workman to create a number of what are known in the art as "bucks" in the outer walls of the dwelling. Each buck is generally formed by placing a pair of 2×4 inch studs of the wall approximately 3.5 inches apart from each other (3.5 inches being the approximate, actual length of a standard 2×4 inch stud). A third 2×4 inch stud is then placed transversely between the pair of studs and secured fixedly therebetween by nailing or stapling. This forms the buck, which is an elongated cavity opening outwardly relative to the third 2×4 inch stud.

Each buck is placed in a wall portion of the dwelling to provide an attachment surface for an interior wall connected to the outer wall, where the interior wall extends generally transversely from the outer wall, and also to permit the attachment of outside walls together. The third 2×4 inch stud, cooperating to form the buck, provides a surface by which another 2×4 inch stud of the transversely extending interior wall may be nailed or stapled thereto to help secure the interior wall fixedly relative to the exterior wall. This form of construction has been found over the years to represent an efficient, easy and uncomplicated way of readily forming an area of outer wall which enables an inner wall to be quickly and easily secured transversely thereto.

The use of bucks in constructing dwellings and other buildings such as residential houses has been well accepted by carpenters and other like skilled workman, and at the present time may be one of the most common construction techniques in use for providing means of securing inner walls extending transversely from outer walls. However, the creation of a buck has definite disadvantages with regard to insulating of a house or other like dwelling. The formation of the buck creates an elongated cavity within which air, often cold air, may circulate and eventually make its way into the interior area of the dwelling. This typically is the cause of "cold" or "drafty" corners of houses where the occupant notes a significant temperature change from the remaining area of a room, and also ice build-up on outside corners.

At the present time, residential houses having approximately about 1,800 sq. ft. have been found to typically have 25 to 30 bucks. Homes with 4,200 sq. ft. have been found to have between 40 and 50 bucks. Most houses typically include about 20 to 50 bucks. It has also been estimated that up to about 10% of the total heat used to heat a house is lost through the bucks of the house. A dwelling having 8 foot ceilings and just 25 bucks would produce a total uninsulated area of roughly about 7.29 square feet (i.e., 3.5"×92⅝"×25).

National research has also found that heating and cooling costs typically represent 50% to 72% of the total utility costs associated with most dwelling structures. Accordingly, bucks formed during the construction process of a typical house or building contribute significantly to insulating losses which, in turn, can contribute significantly to higher energy costs.

Typical construction materials used on the outside walls of most homes generally provide little or no help in insulating the bucks of the exterior walls. Typically, the outer surfaces of outer walls of most houses being constructed at the present time only incorporate some form of outer sheathing, such as one-half inch thick plywood, having little or no insulating value. Vinyl siding, brick, and most other woods are similarly deficient in providing adequate insulation of the buck areas of exterior walls.

Accordingly, it is a principal object of the present invention to provide a method and apparatus for positively insulating the buck area of exterior walls of dwellings such as houses or commercial structures to thereby significantly increase the efficiency with which such structures may be heated in the winter and cooled in the summer, and thereby reduce the energy costs to the owner and/or occupant of the structure.

It is a further object of the present invention to provide a method and apparatus which contemplates placing an elongated insulating member having dimensions enabling it to substantially fill the bucks of exterior walls within the bucks while the exterior walls are under construction.

It is yet another object of the present invention to provide a method and apparatus for insulating the buck areas of walls, which method and apparatus contemplates the placing of elongated insulating members having predetermined lengths, widths and depths, which enable them to be placed quickly and easily within the buck areas of walls by a carpenter or other skilled workman while the walls are under construction.

SUMMARY OF THE INVENTION

The above and other objects are accomplished by the method and apparatus in accordance with the preferred embodiments of the present invention. The method and apparatus of the present invention contemplates the use of an elongated insulating member which may be placed quickly, easily and efficiently within a buck area of a wall while the wall is under construction.

The method generally comprises forming a buck by placing a pair of 2×4 inch studs approximately 3.5 inches apart. A third 2×4 inch stud is then secured transversely in between the pair of 2×4 inch studs such that an outer surface of the third 2×4 is relatively flush with rearmost edge surfaces of the pair of 2×4 inch studs. This results in an elongated cavity opening outwardly relative to the third 2×4 inch stud, which cavity is known in the art as a buck. The method contemplates the placing of an elongated insulating member having width and depth dimensions generally in accordance with width and depth dimensions of the third 2×4 inch stud within the buck such that an outer surface of the elongated insulating member is relatively flush with forwardmost edge surfaces of the pair of 2×4 inch studs. When placed within the buck, the elongated insulating member substantially, and generally tightly, fills the buck and eliminates a dead air space which would normally otherwise exist. A sheet of outer sheathing may then be secured over the forwardmost edge surfaces of the pair of 2×4 inch studs and the outer surface of the elongated insulating member.

The apparatus of the present invention generally comprises an elongated insulating member which has good insulating properties (i.e. a high "R" value), is generally rigid, relatively light in weight, and easily handled, transported and packaged. The insulating member has generally precise dimensions of 3.5 inches in width and about 2 inches in depth, and may be comprised of a styrofoam-like material having good insulating ability.

The method and apparatus of the present invention operates to enable carpenters and other skilled construction workers to quickly and easily insulate the bucks of walls of buildings such as residential houses without significantly slowing down or complicating the construction process. The method and apparatus of the present invention further enables energy savings of typically between about 5% to 10% to be realized by the owner and/or occupant of the dwelling when heating the dwelling in the winter and/or cooling the dwelling in the summer.

BRIEF DESCRIPTION OF THE DRAWINGS

Other objects, advantages and features of the present invention will become apparent to one skilled in the art upon reading the following description and dependent claims, taken in conjunction with the following drawings wherein:

FIG. 1 is a plan view of a typical residential house having a garage attached thereto, illustrating where bucks are located in the outer walls of the house;

FIG. 2 is a fragmentary, perspective view of a pair of 2×4 inch studs and a third 2×4 inch stud forming an elongated cavity generally known in the art as a buck, and a section of outer sheathing covering the buck;

FIG. 3 is an illustration of how an elongated insulating member in accordance with a preferred embodiment of the present invention may be manually, slidably inserted into a buck area to substantially fill the buck;

FIG. 4 is an illustration of an insulating member of FIG. 3 placed within the buck;

FIG. 5 is an illustration of the insulating member of FIGS. 3 and 4 illustrating a first preferred width of the insulating member and a portion of a sheet of outer sheathing secured thereto; and FIG. 6 is a side elevational view of the insulating member of FIG. 5 showing a first preferred height and depth of the insulating member.

DETAILED DESCRIPTION OF THE PREFERRED EMBODIMENTS

Referring to FIG. 1 there is shown an elevational plan view of a typical residential house 10 having a garage attached thereto. At each of the areas indicated by reference numeral 11 a "buck" is typically created by a carpenter or other like workman when constructing outer walls 12, 14, 16 and 18 of the house 10. In an 1,800 sq. ft. house, it is has been found that 25 to 30 bucks are typically present. In houses over 4,000 sq. ft., between 40 and 50 bucks have been found to be typical. As will be described more fully hereinafter, each buck represents a significant energy loss which contributes markedly towards increasing the energy costs associated with heating and cooling residential houses.

Referring to FIG. 2, it can be seen more clearly how a buck 20 is formed. A pair of 2×4 inch studs 22 and 24 are first placed roughly about 3.5 inches apart (3.5 inches being the approximate width of a standard 2×4 inch construction stud). A third 2×4 inch stud 26 is then inserted transversely between studs 22 and 24 and secured therebetween via nails or staples. Stud 22 has inner and outer surfaces **22*a* and 22*b* respectively, forwardmost and rearwardmost end portions 22*c* and 22*d* respectively, and front and rear edge surfaces 22*e* and 22*f*. Stud 24 similarly has inner and outer surfaces 24*a* and 24*b* respectively, forwardmost and rearwardmost end portions 24*c* and 24*d*, and forward and rearward edge surfaces 24*e* and 24*f***.

The third 2×4 inch stud 26 similarly includes inner and outer surfaces **26*a* and 26*b* respectively, in addition to side surfaces 26*c* and 26*d*. A sheet of sheathing 28 is also illustrated and typically represents a sheet of plywood, typically about one-half inch thick, which abuttingly engages the front edge surfaces 22*e* and 24*e* of studs 22 and 24 when secured thereto via nails 28*a* or staples 28*b*. As should be appreciated from FIG. 2, the buck 20 represents a "dead air" space within which cold or warm air may circulate and make its way into the interior area of a house. The sheathing 28 provides little or no insulating benefits in preventing air from moving freely within buck 20 and then making its way into the interior of the house 10**.

The use of bucks such as buck 20 has found generally wide acceptance in the construction industry, particularly with regard to residential houses. The creation of buck 20, through the use of three independent 2×4 inch studs, enables a nailing surface to be created (i.e., surface **26*b* of the third stud 26**) when attaching interior walls that run transversely from the respective exterior walls, and also enables adjoining exterior walls to be connected more easily. This method of construction has proven to be simple, efficient and is quite popular in the construction of today's residential dwellings and other dwelling structures.

With regard to FIGS. 3 and 4, the steps of insulating buck 20 are illustrated in accordance with a preferred method of the present invention. An insulating member 30 in accordance with the present invention is first aligned over the buck 20. The insulating member 30 has a width and depth in accordance with the dimensions of the buck (i.e., approximately 3.5 inches and 2 inches, respectively). The insulating member 30 is manually placed slidably within the buck 20 to substantially fill the cavity comprising the buck 20. The insulating member 30 is further placed within the buck 20 while the studs 22, 24 and 26 are in a preferably horizontal orientation relative to the ground, such as resting on the ground. Once inserted within the buck 20, the entire assembly of the studs 22, 24 and 26 and the insulating member 30 may be raised to an upright position generally transverse to the ground. This is the preferred form of constructing walls of residential dwellings, where the entire wall is assembled while positioned generally horizontally relative to the ground and then raised into a upright position prior to attaching other walls thereto. It should be appreciated, however, that the insulating member 30 could be inserted while the assembly of studs 22, 24 and 26 are in an upright position if particular circumstances exist. It should also be noted that once sheathing 28 is attached, as shown in FIG. 4, standard present construction techniques most often involve attaching one ore more additional 2×4 inch studs, also known as plates, across the longitudinal outermost end portions of studs 22, 24 and 26, before a wall made up of one or more bucks 20 is raised into an upright position. Accordingly, once in an upright position with sheathing 28 secured thereto, it would be difficult, and likely impossible, to insert insulating member 30.

With further reference to FIG. 4, it can be seen how the insulating member 30 fits securely within the buck 20 and substantially fills the buck 20 to remove the dead air space otherwise normally provided by the buck 20.

Referring to FIGS. 5 and 6, the insulating member 30 of the present invention is illustrated. The insulating member 30 preferably comprises an elongated, generally rigid, styrofoam-like insulating material which may be handled and transported easily, and which is further relatively light in weight and has a relatively high "R" value. A preferred material for insulating member 30 is extruded polystyrene because of its high "R" value per inch. Extruded polystyrene insulating material is commercially available from a variety of manufacturers. It will be appreciated, however, that many other insulating materials may be employed as long as they may be formed generally reliably and uniformly into a shape adapted to substantially occupy buck 20 without significant deformation, and which remain generally of the same dimensions they are manufactured to, and which have a relatively high "R" value per inch.

With further reference to FIGS. 5 and 6, house 10, made up of 2×4 inch studs 22, 24 and 26, would require a plurality of insulating members 30 each having a width 36 of about 3.5 inches and a depth or thickness 38 of about 2 inches. A preferred length 40 of the insulating member 30 is about 92 and $\frac{5}{8}$ inches, which is a standard length for studs used in the construction of residential housing having 8 foot ceilings. By manufacturing the insulating member 30 in accordance with the just mentioned dimensions, the insulating member 30 will be readily slidably insertable into the bucks 20 of residential houses with no on-site modification such as cutting, trimming, etc., thereof.

The above-described method and apparatus of insulating the bucks 20 of the house 10 provides significant advantages over other attempts to insulate bucks of a house. One such alternative attempt is to blow in insulation after drilling holes in sheathing 28 or in other 2×4 inch studs covering the opposing end portions of the insulating member 30. As will be appreciated, this requires trial and error drilling to locate precisely the area forming the buck 20, and accordingly results in significant added labor costs. Furthermore, in some instances such as when brick has been installed over sheathing 28, the job of obtaining access to the buck 20 is complicated still further. The method and apparatus of the present invention is believed to represent the most efficient easy and cost effective means to insulate the bucks of a house or other dwelling structure. Moreover, the method and apparatus of the present invention does not significantly complicate the construction process of such dwellings, and does not require skilled construction workers such as carpenters to alter accepted and efficient construction techniques.

The method and apparatus of the present invention provides significant energy savings to owners and/or occupants of dwellings. It has been found that up to 10% of the total energy used in heating and cooling a residential dwelling is lost through the bucks formed in the outer walls of the dwelling. Accordingly, the method and apparatus of the present invention can represent a significant energy savings of close to 10% in the total energy costs of heating and cooling residential homes.

It is a further significant advantage of the present invention that the bucks of a house may be quickly, easily, and relatively inexpensively insulated without significantly complicating the construction process. Furthermore, the method may be practiced without the need for any special training, tools or procedures such as cutting or trimming, etc. With the just mentioned dimensions, insulating member 30 will substantially and tightly fill a buck made up of 2×4 inch studs.

Although the above description has been provided with regard to a house incorporating 2×4 inch studs for framing, it should be appreciated that the method and apparatus is equally applicable to houses incorporating 2"×6" studs in their framing. In such instances, the insulating member 30 will have a width of preferably about $5\frac{1}{2}$", a depth of about 4" and a total length of about 92 and $\frac{5}{8}$". Preferably, the length 40 of the insulating member 30 will be equivalent to studs 22, 24 and 26.

Although the method and apparatus of the present invention has been described primarily in connection with the insulation of residential dwellings such as houses, it will be appreciated that the teachings presented herein are equally applicable to any building or structure having at least one outer wall comprising at least one buck, where an interior area at least partially formed by the outer wall is desired to be insulated from heat and cold.

While the above description constitutes the preferred embodiment of the invention, it will be appreciated that the invention is susceptible to modification, variation, and change without departing from the proper scope or fair meaning of the accompanying claims.

What is claimed:

1. A method for insulating a buck area of a wall at a work site with an elongated insulating member having a pre-determined height, length and width, and a predetermined shape, said method comprising the steps of:

forming at least one buck in a wall by securing first and second studs a predetermined distance apart and securing a third stud transversely between said first and second studs at rearwardmost end portions of said first and second studs, to thereby form an elongated cavity opening outwardly relative to said third stud representing said buck, said cavity having approximate dimensions in accordance with dimensions of said insulating member;

slidably inserting said elongated insulating member securely within said buck, while at said work site, to substantially occupy said buck, an outer surface of said elongated insulating member being flush with forward edge surfaces of said first and second studs; and placing a sheet of sheathing over said buck such that an inner surface of said sheathing is in abutting contact with forward edge surfaces of said first and second studs and said outer surface of said elongated insulating member.

2. The method of claim 1, further comprising securing said sheet of sheathing to said forward edge surfaces of said first and second studs via nails.

3. The method of claim 1, further comprising securing the sheet of sheathing to the forward edge surfaces of said first and second studs via staples.

4. The method of insulating a wall of a building such as a house at a work site, with a pre-formed, elongated insulating member, comprising the steps of:

fixedly securing at least one pair of 2×4 inch studs each having inner and outer surfaces, rearwardmost end portions, forwardmost end portions, rearward edge surfaces and forward edge surfaces, so as to place said inner surfaces approximately 3.5 inches apart;

placing a third 2×4 inch stud having inner and outer surfaces and said surfaces transversely between said inner surfaces of said pair of 2×4 inch studs such that said side surfaces of said third 2×4 inch stud are in abutting, flush engagement with said inner portions of each of said pair of 2×4 inch studs and said outer surface of said third 2×4 inch stud is generally flush with said rearward edge surfaces of said pair of 2×4 inch studs, to thereby form an elongated cavity opening outwardly relative to said inner surface of said third 2×4 inch stud, said cavity representing a buck;

fixedly securing said third 2×4 inch stud to said pair of 2×4 inch studs;

slidably inserting said preformed, elongated insulating member into said buck, said preformed, elongated insulating member having a length corresponding to a length of said third 2×4 inch stud, a width of approximately 3.5 inches, and a depth of approximately 2 inches, said preformed, elongated insulating member having inner and outer surfaces and side surfaces, said outer surface being flush with said forward edge surfaces of each of said pair of 2×4 inches studs, said side surfaces of said elongated insulating member being in generally abutting engagement with said inner surfaces of said pair of 2×4 inch studs, and said inner surface of said elongated member being in general abutting engagement with said inner surface of said third 2×4 inch stud; and placing a sheet of sheathing over said forward edge surfaces of said pair of 2×4 inch studs and said outer surface of said elongated insulating member.

5. The method of claim 4, wherein said elongated insulating member is placed within said buck while said pair of 2×4 inch studs are positioned generally horizontal relative to the ground.

6. The method of claim 5, wherein said sheet of sheathing is secured to said pair of 2×4 inch studs while said pair of 2×4 inch studs are positioned generally horizontal relative to the ground.

7. The method of claim 6, wherein said pair of 2×4 inch studs and said sheet of sheathing secured thereto are raised manually into a generally upright position to form at least a portion of a wall of said building.

8. An elongated, generally rigid insulating member for insulating a buck of a wall of a dwelling such as a house while said dwelling is under construction, said apparatus comprising:

an elongated, generally rigid section of styrofoam-like insulating material;

said insulating material having a height of approximately 92.625 inches, a width of approximately 3.5 inches, and a depth of approximately 2 inches;

said insulating member being adapted to be manually, slidably inserted within a buck of a wall while said wall is under construction at said work site, and before said wall is stood upright.

* * * * *